US005998078A

United States Patent [19]

Suwabe et al.

[11] Patent Number: 5,998,078

[45] Date of Patent: Dec. 7, 1999

[54] METHOD OF PREPARING TONER FOR ELECTROSTATIC CHARGE IMAGE DEVELOPMENT, TONER FOR ELECTROSTATIC CHARGE IMAGE DEVELOPMENT, ELECTROSTATIC CHARGE IMAGE DEVELOPER, AND IMAGE FORMING METHOD

[75] Inventors: Masaaki Suwabe; Yasuo Matsumura; Manabu Serizawa; Shuji Sato; Yasuo Kadokura; Hisao Morijiri; Takahiro Mizuguchi; Takeshi Shoji, all of Minami-Ashigara, Japan

[73] Assignee: Fuji Xerox Co., Ltd., Tokyo, Japan

[21] Appl. No.: 09/004,343

[22] Filed: Jan. 8, 1998

[30] Foreign Application Priority Data

Jan. 10, 1997 [JP] Japan ..... 9-003182

[51] Int. Cl.[6] ..... G03G 9/087

[52] U.S. Cl. ..... 430/110; 430/137

[58] Field of Search ..... 430/137, 109, 430/111, 110

[56] References Cited

U.S. PATENT DOCUMENTS

| | | | |
|---|---|---|---|
| 5,604,068 | 2/1997 | Miyamoto et al. | 430/137 |
| 5,622,806 | 4/1997 | Veregin et al. | 430/137 |
| 5,741,618 | 4/1998 | Shigemori et al. | 430/137 |

FOREIGN PATENT DOCUMENTS

| | | |
|---|---|---|
| 63-282752 | 11/1988 | Japan . |
| 6-250439 | 9/1994 | Japan . |

*Primary Examiner*—John Goodrow

*Attorney, Agent, or Firm*—Oliff & Berridge, PLC

[57] ABSTRACT

The present invention provides a method of preparing a toner for electrostatic charge image development comprising the steps of a liquid mixture preparation process for preparing a liquid mixture by mixing at least a resin particle dispersion prepared by dispersing resin particles in a solution including a dispersing agent having a polarity, and a coloring agent particle dispersion prepared by dispersing coloring agent particles in a solution including a dispersing agent having a polarity, an aggregated particle dispersion preparation process for preparing an aggregated particle dispersion by forming aggregated particles in the liquid mixture, and a fusion process for fusing the aggregated particles by heating, wherein the first dispersing agent and the second dispersing agent have the same polarity, a toner for electrostatic charge image development obtained by the method, an electrostatic charge image developer containing the toner and a carrier for electrophotography, and an image forming method comprising the steps of a process for forming an electrostatic latent image on an electrostatic latent image carrying member, a process for forming a toner image by developing the electrostatic latent image by a developer layer on a developing carrying member, and a transfer process for transferring the toner image onto a transferring member.

20 Claims, No Drawings

METHOD OF PREPARING TONER FOR ELECTROSTATIC CHARGE IMAGE DEVELOPMENT, TONER FOR ELECTROSTATIC CHARGE IMAGE DEVELOPMENT, ELECTROSTATIC CHARGE IMAGE DEVELOPER, AND IMAGE FORMING METHOD

BACKGROUND OF THE INVENTION

1. Field of the Invention

The present invention relates to a method of efficiently preparing a toner for electrostatic charge image development having excellent characteristics including charging properties, preferably used in image formation in the electrophotographic method, a toner for electrostatic charge image development prepared by the method, an electrostatic charge image developer containing the toner for electrostatic charge image development, and an image forming method using the toner for electrostatic charge image development.

2. Description of the Related Art

Currently, methods for visualizing image information via an electrostatic charge image, such as the electrophotographic method are widely used in various fields. In the electrophotographic method, an electrostatic charge image is formed on a photosensitive member by a charging process, an exposing process, and the like, and is then visualized by developing the electrostatic image with a developer containing toner particles, and by a transfer process, a fixing process, and the like.

As the developer, a two-component type developer containing toner particles and carrier particles, and a one-component type developer containing magnetic toner particles or nonmagnetic toner particles, are known. The toner particles in the developer are, in general, produced by a kneading pulverizing method. The kneading pulverizing method is a method for producing desired toner particles by melting and kneading a thermoplastic resin and the like together with a pigment, a charge controlling agent, a releasing agent such as a wax and the like, then cooling the mixture, finely pulverizing the molten kneaded product, and classifying the same. To toner particles produced by the kneading pulverizing method, inorganic/organic fine particles can be further added to the surface as needed in order to improve the flowability, the cleaning properties, and the like.

In the case of toner particles produced by the kneading pulverizing method, in general, the shape thereof is amorphous, and the surface composition thereof is not homogeneous. Although the shape or the surface composition of the toner particles may change slightly according to their pulverizing properties of the material and the conditions of the pulverizing process, it is difficult to intentionally control them to a desired degree. In particular, in the case of toner particles produced by the kneading pulverizing method using a material with a high pulverizing properties, it is often the case that the particles become finer or form a different shape due to various kinds of mechanical force such as shearing force in the developing device. As a result, problems arise such as with a two-component type developer, the finer toner particles adhere to the carrier surface to accelerate charge deterioration in the developer, or with a one-component developer, the particle size distribution is enlarged so that the image quality is deteriorated by the finer toner particles being scattered, or the developing properties deteriorate due to the toner shape change.

In cases where the toner particle shape is amorphous, problems remain such as even if a flowability adjuvant is added thereto, the flowability is insufficient to prevent fine particles of the flowability adjuvant moving to concave portions of the toner particles and being buried therein by mechanical forces such as shearing force to lower the flowability, or deteriorate the developing properties, the transfer properties, the cleaning properties, and the like as time passes. Moreover, if such a toner is recovered by a cleaning treatment to be returned to the developing device for reuse, the problem of it being liable to deteriorate the image quality arises. In order to prevent these problems, it is conceivable to add more flowability adjuvant, however, problems such as the generation of black dots on the photosensitive member or particle scattering of the flowability adjuvant arise in this case.

On the other hand, in the case of a toner containing a releasing agent such as wax, the releasing agent may be exposed on the toner particle surface depending on the combination with a thermoplastic resin. In particular, in cases involving a toner comprising a combination of a resin endowed with elasticity due to a high molecular weight component making it not easily pulverized, and a brittle wax such as polyethylene, polyethylene exposure is often observed on the toner particle surface. Although such a toner is advantageous in terms of its releasing properties at the time of fixation, and cleaning of untransferred toner from the photosensitive member, problems arise such as since the polyethylene on the surface of the toner particles drops away from the toner particles due to mechanical forces such as shearing force in the developing device and easily transfers to the developing roll, the photosensitive member, the carrier, and the like, these members can be easily contaminated to ruin their reliability as developers.

Under such circumstances, recently, an emulsion polymerization aggregation method has been proposed as a means for preparing a toner with a particle shape and a surface composition intentionally controlled in Japanese Patent Application Laid Open (JP-A) Nos. 63-282752 and 6-250439. The emulsion polymerization aggregation method includes a mixing process where a coloring agent dispersion, prepared by dispersing a coloring agent in a solvent, is mixed with a resin dispersion, formed from an emulsion polymerization, an aggregating process where aggregate particles corresponding to the size of the toner particles are formed, and a fusion process where the aggregate particles are fused through being heated. According to the emulsion polymerization aggregation method, by selecting the heating temperature conditions, the toner shape can be optionally controlled from the amorphous to the spherical.

However, in the case of the emulsion polymerization aggregation method, since the degree of dispersion of the pigment in the toner particles is low with a scattered distribution, and the size of dispersed particles is large compared with the kneading pulverizing method, the colorizing ability of the toner particles obtained is low and thus problems arise in terms of color reproductivity, OHP transmission properties, and the like, particularly in case where a color toner is thus obtained.

In the conventional emulsion polymerization aggregation method, in general, toner particles are obtained by mixing a resin particle dispersion containing an ionic surfactant and a pigment dispersion containing an ionic surfactant of the opposite polarity, so as to form aggregated particles of the toner size by generating hetero aggregation, and fusing the aggregated particles by heating the same to a temperature over the glass transition point of the resin comprising the resin particles.

In this case, however, since the charge of the particles are neutralized and the hetero aggregation is generated at the time of mixing of the resin particle dispersion and the pigment dispersion, it takes time from mixing both dispersions until the liquid mixture becomes homogeneous so that pigments with a neutralized charge are aggregated at the same time, and thus the degree of dispersion of the pigment in the toner is lessened. As a result, the problem arises that the coloring properties of the obtained toner is insufficient.

On the other hand, in order to maintain and perform the toner functions stably under various kinds of mechanical stresses in the electrophotographic process, it is necessary to restrain the releasing agent exposure on the toner particle surface, to improve the surface hardness of the toner particles, and to improve the smoothness of the toner particle surface. Although the releasing agent may cause various problems when it is exposed on the toner particle surface, it is preferable that it exists in the vicinity of the toner particle surface in consideration of the toner functions at the time of fixation.

These days, a higher image quality is called for, and particularly in color image formation, there has been a marked trend to smaller sized toner particles in order to realize high resolution images. However, even if a smaller particle size is achieved, if the conventional toner particle size distribution remains as it is, problems such as the carrier or the photosensitive member becoming contaminated or the toner scattering become significant due to the existence of toner at the finer side of the particle size distribution so that it is difficult to realize a high image quality and a high reliability at the same time. In order to realize a high image quality and a high reliability at the same time, it is necessary to sharpen the particle size distribution of the toner as well as reduce the size of the particles.

SUMMARY OF THE INVENTION

Tasks of the present invention include solving the above-mentioned conventional problems and achieving the below-mentioned object. That is, an object of the present invention is to provide a highly reliable toner for electrostatic charge image development having excellent properties including coloring properties, charging properties, developing properties, transfer properties and fixing properties, particularly, the charging properties and the coloring properties, and an electrostatic charge image developer containing the toner for electrostatic charge image development. Another object of the present invention is to provide a method of preparing the toner for electrostatic charge image development capable of producing a toner for electrostatic charge image development easily and conveniently. Yet another object of the present invention is to provide an image forming method capable of forming a high quality and highly reliable image easily and conveniently.

In order to solve the above-mentioned problems, the present inventors have studied conditions in the mixing process and the aggregating process of the emulsion polymerization aggregation method. As a result, they have found out that by the use of a resin dispersion and a pigment dispersion containing a dispersing agent of the same polarity as the dispersing agent in the resin dispersion in the mixing process, both can be mixed homogeneously. Further, by gradually adding an aggregating agent having the opposite polarity to that of these dispersing agents into the liquid mixture in the subsequent aggregating process, the pigments can be distributed in a dispersed state without aggregating. The present invention is based on the knowledge of the present inventors, and means for solving the problems are as follows.

That is, a first aspect of the present invention is a method of preparing a toner for electrostatic charge image development comprising the steps of a liquid mixture preparation process for preparing a liquid mixture by mixing at least a resin particle dispersion prepared by dispersing resin particles in a solution including a first dispersing agent having a polarity, and a coloring agent particle dispersion prepared by dispersing coloring agent particles in a solution including a second dispersing agent having a polarity, an aggregated particle dispersion preparation process for preparing an aggregated particle dispersion by forming aggregated particles in the liquid mixture, and a fusion process for fusing the aggregated particles by heating, wherein the first dispersing agent and the second dispersing agent have the same polarity.

A second aspect of the present invention is a toner obtained by a method of preparing a toner for electrostatic charge image development comprising the steps of a liquid mixture preparation process for preparing a liquid mixture by mixing at least a resin particle dispersion prepared by dispersing resin particles in a solution including a first dispersing agent having a polarity, and a coloring agent particle dispersion prepared by dispersing coloring agent particles in a solution including a second dispersing agent having a polarity, an aggregated particle dispersion preparing process for preparing an aggregated particle dispersion by forming aggregated particles in the liquid mixture, and a fusion process for fusing the aggregated particles by heating, wherein the first dispersing agent and the second dispersing agent have the same polarity.

A third aspect of the present invention is an electrostatic charge image developer containing a carrier for electrophotography and a toner for electrostatic charge image development obtained by a method of preparing a toner for electrostatic charge image development comprising the steps of a liquid mixture preparation process for preparing a liquid mixture by mixing at least a resin particle dispersion prepared by dispersing resin particles in a solution including a first dispersing agent having a polarity, and a coloring agent particle dispersion prepared by dispersing coloring agent particles in a solution including a second dispersing agent having a polarity, an aggregated particle dispersion preparation process for preparing an aggregated particle dispersion by forming aggregated particles in the liquid mixture, and a fusion process for fusing the aggregated particles by heating, wherein the first dispersing agent and the second dispersing agent have the same polarity.

A fourth aspect of the present invention is an image forming method comprising the steps of a process for forming an electrostatic latent image on an electrostatic latent image carrying member, a process for forming a toner image by developing the electrostatic latent image using a developer layer on a developing carrying member, and a transfer process for transferring the toner image onto a transferring member, wherein the developer layer contains a toner for electrostatic charge image development obtained by a method of preparing a toner for electrostatic charge image development comprising the steps of a liquid mixture preparation process for preparing a liquid mixture by mixing at least a resin particle dispersion prepared by dispersing resin particles in a solution including a first dispersing agent having a polarity, and a coloring agent particle dispersion prepared by dispersing coloring agent particles in a solution including a second dispersing agent having a polarity, an aggregated particle dispersion preparation process for preparing an aggregated particle dispersion by forming aggregated particles in the liquid mixture, and a fusion process for fusing the aggregated particles by heating, wherein the first dispersing agent and the second dispersing agent have the same polarity.

DESCRIPTION OF THE PREFERRED EMBODIMENTS

<Preparation method of a toner for electrostatic charge image development>

The method for preparing a toner for electrostatic charge image development of the present invention includes at least a liquid mixture preparing process, an aggregated particle forming process, and a fusion process. The method for preparing a toner for electrostatic charge image development of the present invention can further include other optional processes as needed, such as an adhered particle forming process between the aggregated particle forming process and the fusion process.

The liquid mixture preparing process is a process for preparing a liquid mixture by mixing at least a resin particle dispersion prepared by dispersing resin particles in a dispersing agent having a polarity, and a coloring agent particle dispersion prepared by dispersing coloring agent particles in a dispersing agent having a polarity. The aggregated particle forming process is a process for preparing an aggregated particle dispersion by forming aggregated particles in the liquid mixture. The fusion process is a process for fusing the aggregated particles by heating. The adhered particle forming process is a process for forming adhered particles by adding and mixing a fine particle dispersion prepared by dispersing fine particles in a dispersing agent having a polarity to the aggregated particle dispersion so as to adhere the fine particles onto the aggregated particles.

In the liquid mixture preparation process of a method for preparing a toner for electrostatic charge image development of the present invention, resin particles and coloring agent particles are homogeneously dispersed and mixed in a liquid mixture containing a resin particle dispersion and a coloring agent particle dispersion and the like. Herein since the dispersing agents contained in the liquid mixture have the same polarity, particles contained in the liquid mixture do not aggregate. Therefore, the resin particles, the coloring agent particles, and the like are homogeneously dispersed in the liquid mixture.

In the aggregated particle forming process, the homogeneously dispersed resin particles, coloring agent particles, and the like in the liquid mixture aggregate to form aggregated particles. The aggregated particles are formed by hetero aggregation. That is, by adding an aggregating agent having the opposite polarity to that of the dispersing agent contained in the liquid mixture in the aggregated particle forming process, the polarity discrepancies between the side to be added to (the liquid mixture) and the side to be added (the aggregating agent) can be compensated so that the hetero aggregation is generated at that time.

In the fusion process, the resin in the aggregated particles are melted and fused so that toner particles for electrostatic charge image development can be formed.

In the adhered particle forming process, with the aggregated particles as mother particles, fine particles contained in a fine particle dispersion added and mixed to the aggregated particle dispersion where the aggregated particles are dispersed, are adhered on the surface thereof so as to form adhered particles. If the adhered particle forming process is included before the fusion process, the resin in the adhered particles is melted and fused so as to form toner particles for electrostatic charge image development in the fusion process.

Since the coloring agent particle size distribution in the aggregated particles will be the coloring agent particle size distribution in the toner particles finally, the coloring properties of the obtained toner particles can be improved as the dispersion of the coloring agent particles becomes smaller and more homogeneous. In the method for preparing a toner for electrostatic charge image development of the present invention, since the coloring agent particles are homogeneously dispersed in the aggregated particles in the aggregated particle forming process, the coloring properties of the obtained toner particles for electrostatic charge image development can be extremely good. The coloring properties are important, especially for color toners, since they directly affect color reproductivity or OHP transmission properties. A toner for electrostatic charge image development obtained by the method for preparing a toner for electrostatic charge image development of the present invention is advantageous in terms of color reproductivity and OHP transmission properties. Furthermore, the toner particles for electrostatic charge image development are advantageous for their ease of cleaning, excellent charging properties, and for the fact that their properties, particularly the charge properties, are not easily changed by environmental conditions.

Hereinafter, processes in the method for preparing the toner for electrostatic charge image development of the present invention will be explained.

(Liquid mixture preparation process)

The liquid mixture preparation process is a process for preparing a liquid mixture by mixing at least a resin particle dispersion prepared by dispersing resin particles in a dispersing agent having a polarity, and a coloring agent particle dispersion prepared by dispersing coloring agent particles in a dispersing agent having a polarity.

The resin particle dispersion contains at least resin particles dispersed in a dispersing agent having a polarity.

As the resin, thermoplastic binder resins can be presented. Specific examples include a homopolymer or a copolymer of styrenes (styrene resin), such as styrene, parachloro styrene, and a-methyl styrene; a homopolymer or a copolymer of esters having a vinyl group (vinyl resin), such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; a homopolymer or a copolymer of vinyl nitrites (vinyl resin), such as acrylonitrile, and methacrylonitrile; a homopolymer or a copolymer of vinyl ethers (vinyl resin), such as vinyl methylether, and vinyl isobutylether; a homopolymer or a copolymer of vinyl ketones (vinyl resin), such as vinyl methyl ketone, vinyl ethylketone, and vinyl isopropenylketone; a homopolymer or a copolymer of olefins (olefin resin), such as ethylene, propylene, butadiene, and isoprene; a non-vinyl condensed resin, such an epoxy resin, a polyester resin, a polyurethane resin, a polyamide resin, a cellulose resin, a polyether resin, and a graft copolymer of a vinyl monomer and these non-vinyl condensed resins. These resins can be used alone or in combination of two or more.

Among these resins, vinyl resins are particularly preferable. The vinyl resins are advantageous in that a resin particle dispersion can be prepared easily, using an ionic surfactant in an emulsion polymerization or a seed polymerization.

Examples of the vinyl monomer include monomers to be the material for a vinyl polymer acid or a vinyl polymer base, such as acrylic acid, methacrylic acid, maleic acid, cinnamic acid, fumaric acid, vinyl sulfonic acid, ethylene imine, vinyl pyridine, and vinyl amine. In the present invention, it is preferable that the resin particles contain a vinyl monomer as the monomer component. In the present invention, a vinyl polymer acid is more preferable among the vinyl monomers in view of the ease of the vinyl resin formation reaction. Specific examples thereof include a dissociating vinyl monomer having a carboxyl group as a dissociation group such as acrylic acid, methacrylic acid, maleic acid, cinnamic acid, and fumaric acid. They are particularly preferable in terms of controlling the polymerization degree or the glass transition point.

The average particle size of the resin particles is, in general, 1 μm or less, preferably 0.01 to 1 μm. If the average particle size exceeds 1 μm, the particle size distribution of the toner for electrostatic charge image development finally obtained becomes wider, or free particles are generated so that properties and reliability are easily deteriorated. On the other hand, an average particle size within the above-mentioned range is advantageous in that the above-mentioned problems are not caused and, additionally, deviation of particles in the toner is reduced improving the dispersion in the toner, and reducing variations in performance and reliability. The average particle size can be measured with coulter counter.

The coloring agent particle dispersion contains at least coloring agent particles dispersed in a dispersing agent having a polarity.

Examples of the coloring agent include phthalocyanine pigments, mono azo pigments, bis azo pigments, magnetic powders, and quinacrydone pigments.

Specific examples thereof include pigments, such as carbon black, Chrome Yellow, Hanza Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, Dupont Oil Red, Pyrazolone Red, Lithol Red, Rhodamine B Lake, Lake Red C, Rose Bengale, Aniline Blue, Ultramarine Blue, Chalcoil Blue, Methylene Blue Chloride, Phthalocyanine Blue, Phthalocyanine Green, and Malachite Green oxalate; and dyes, such as acridine types, xanthene types, azo types, benzoquinone types, azine types, anthraquinone types, dioxazine types, thiazine types, azomethine types, indigo types, thioindigo types, phthalocyanine types, aniline black types, polymethine types, triphenyl methane types, diphenyl methane types, thiazine types, thiazole types, and xanthene types. These coloring agents may be used alone or in combinations of two or more.

The average particle size of the coloring agent is, preferably 0.5 μm or less, more preferably 0.02 or less. An average particle size larger than 0.5 μm is not preferable since it cannot prevent irregular reflection of visible light, furthermore, if coarse particles are present, it negatively affects the coloring properties, the color reproductivity and the OHP transmission properties so that the resin particles and the coloring agent particles cannot aggregate in the aggregated particle forming process later described. Even if the resin and coloring agent particles are aggregated, they may drop away at the time of fusion to deteriorate the quality of the toner for electrostatic charge image development to be obtained. On the other hand, an average particle size within the above-mentioned range eliminates the above-mentioned problems, and is advantageous since deviation of particles in tower can be reduced improving the dispersion in the toner, and reducing variations in the performance and reliability. The average particle size can be measured with coulter counter.

Preferably, the coloring agent particles will have a maximum particle size of not more than 1 μm, and more preferably, 99% of the coloring agent particles will be no bigger than 0.7 μm. It is advantageous to use such coloring agent particles, since the generation of free particles can be restrained.

When dispersing carbon black particles in a dispersion, it is preferable to use an ultrasonic wave. Particularly with an ultrasonic wave of an oscillating frequency of 60 kHz or less, a preferable dispersion can be obtained.

The combination of the coloring agent particles and the resin particles is not particularly limited but can be optionally selected according to the purpose.

In the liquid mixture preparation process, a particle dispersion, comprising optionally selected particles dispersed in a dispersing agent having a polarity, can be further added in addition to the resin particle dispersion and the coloring agent particle dispersion.

Particles contained in the particle dispersion are not particularly limited but can be selected optionally according to the purpose. Examples thereof include releasing agent particles, internal additive particles, charge controlling agent particles, inorganic particles, smoothing agent particles, and abrasive particles. In the present invention, these particles can be dispersed in the resin particle dispersion, or in the coloring agent particle dispersion.

Examples of the releasing agent particles include particles of low molecular weight polyolefins, such as polyethylene, polypropylene, and polybutene; silicones having a softening point through heating; aliphatic amides, such as oleic acid amide, erucic acid amide, recinoleic acid amide, and stearic acid amide; plant waxes, such as carnauba wax, rice wax, candelilla wax, Japan wax, and jojoba oil; animal waxes, such as beewax; ore oil waxes, such as montan wax, ozokerite, ceresine, paraffinwax, microcrystalline wax, and Fischer Tropsch wax; and modified products thereof.

These waxes can be easily processed to be fine particles of 1 μm or less by dispersion in water with an ionic surfactant a high polymer electrolyte, such as, a polymer acid, and a polymer base, heating to the melting point or higher, and treating with a homogenizer capable of applying a strong shearing force or a pressure discharge type disperser.

Examples of the interior additive particles include particles of metals, such as ferrite, magnetite, reduced iron, cobalt, nickel and manganese, alloys, and magnetic substances such as a compound containing these metals.

Examples of the charge controlling agent particles include particles of a quaternary ammonium salt compound, a nigrosine compound, dyes made from a complex of aluminum, iron or chrome, a triphenyl methane pigment, and the like. It is preferable that the charge controlling agent of the present invention is made from a material not liable to dissolve in water in consideration of control of the ion strength, which influences stability at the time of aggregation or fusion, and reduction of waste water pollution.

Examples of the inorganic particles include any particles usually applicable as an external additive to the toner surface, such as silica, alumina, titania, calcium carbonate, magnesium carbonate, calcium phosphate, and cerium oxide.

Examples of the smoothing agent particles include fatty acid amides, such as ethylene bis stearamide, and oleic acid amide, and aliphatic metal salts, such as zinc stearate, and calcium stearate.

Examples of the abrasive particles include particles of silica, alumina and cerium oxide.

The average particle size of the above particles is, in general, 1 μm or less, and preferably 0.01 to 1 μm. An average particle size larger than causes a wider particle size distribution of the toner for electrostatic charge image development to be finally obtained, or generates free particles, and thus it easily causes a deterioration in performance and reliability. On the other hand, an average particle size within the above-mentioned range eliminates the above-mentioned problems, deviation of the particles is the toner can be reduced to improve the dispersion in the toner, and thus it is advantageous in that variations in performance and reliability can be reduced. The average particle size can be measured with coulter counter.

As a dispersing agent having a polarity contained in the resin particle dispersion, the coloring agent particle dispersion, the particle dispersion, and the like, an aqueous medium containing a polar surfactant can be presented. Examples of the aqueous medium include water, such as distilled water and ion exchange water, and alcohols. These can be used alone or in combinations of two or more.

The content of the polar surfactant in the dispersing agent having a polarity cannot be determined generally and thus can be optionally selected according to the purpose.

Examples of the polar surfactant include anionic surfactants, such as sulfate ester salt types, sulfonic acid salt types, phosphoric acid ester types, and soap types; and cationic surfactants, such as amine types and quartenary ammonium types.

Examples of the anionic surfactants include sodium dodecylbenzene sulfonate, sodium dodecylsulfate, sodium alkylnaphthalene sulfonate, and sodium dialkyl sulfosuccinate.

Examples of the cationic surfactants include alkyl benzene dimethylammonium chloride, alkyl trimethylammonium chloride, and distearylammonium chloride.

These can be used alone or in combinations of two or more.

As a dispersing agent contained in the coloring agent dispersion, alkyl benzene sulfonate or sulfate ester salts are preferable. By the use thereof, the dispersion stability of the coloring agent particles in the dispersion can be improved.

In the present invention, these polar surfactants can be used in combination with a non-polar surfactant. Examples of the non-polar surfactant include nonionic surfactants, such as polyethylene glycol types, alkylphenol ethyleneoxide adduct types, and polyhydric alcohol types.

The content of the resin particles in the resin particle dispersion is, in general 5 to 60% by weight, and preferably 10 to 40% by weight. The content of the resin particles in the aggregated particle dispersion where the aggregated particles are formed may be 50% by weight or less, and is preferably 2 to 40% by weight.

When releasing agent particles and the like are dispersed in the liquid mixture, the content of the releasing agent particles and the like in the particle dispersion may be in a range where the objects of the present invention are not obstructed. In general, it is an extremely small amount, namely, 0.01 to 5% by weight in the aggregated particle dispersion where the aggregated particles are formed, and is preferably 0.5 to 2% by weight. When the content is outside the above-mentioned range, properties may deteriorate such as the effect of dispersing the releasing agent particles being insufficient, or the particle size distribution spreading.

The resin particle dispersion can be prepared as follows.

If the resin of the resin particles is a homopolymer or a copolymer of a vinyl monomer (vinyl resin), such as esters having a vinyl group, a vinyl nitrile, a vinyl ether, and a vinyl ketone, by the emulsion polymerization or the seed polymerization of the vinyl type monomer in an ionic type surfactant, a dispersion containing resin particles of a homopolymer or a copolymer of a vinyl monomer (vinyl resin) dispersed in an ionic type surfactant can be prepared.

If the resin of the resin particles is a resin other than a homopolymer or a copolymer of the vinyl monomers, if the resin can be dissolved in an oil type solvent having a comparatively low solubility in water, the resin is dissolved in the oil type solvent and the solution is dispersed in water as fine particles with an ionic surfactant or a polymer electrolyte by a disperser such as a homogenizer, and the oil type solvent is evaporated by heating or reducing pressure so as to obtain a dispersion where the resin particles of a resin other than a vinyl type resin are dispersed in an ionic surfactant.

A means for the dispersion is not particularly limited, but examples thereof include conventionally known dispersers, such as a rotation shearing type homogenizer, a boll mill, a sand mill, and a dyno mill, which have media.

The coloring agent particle dispersion, the particle dispersion, and the like, can be prepared by adding particles such as the coloring agent particles into the dispersion having a polarity, and dispersing the same with the means for dispersion.

In the liquid mixture preparation process, the polarity of the dispersing agents contained in the liquid mixture, that is, the polarities of all the dispersing agents having a polarity contained in the resin particle dispersion, the coloring agent particle dispersion, and the particle dispersion comprising the liquid mixture needs to be the same. Therefore, the dispersing agents having a polarity need to be selected in view of this in the present invention.

(Aggregated particle forming process)

The aggregated particle forming process is a process for preparing an aggregated particle dispersion by forming aggregated particles in the liquid mixture.

The aggregated particles can be formed, for example, in the liquid mixture by adding and mixing an aggregating agent, having the opposite polarity to the polarity of a dispersing agent contained in the liquid mixture, to the liquid mixture.

Examples of an aggregating agent having a polarity include those presented as dispersing agents having a polarity. That is, as the aggregating agents having a polarity, the polar surfactants or an aqueous medium containing the polar surfactants can be presented. For example, when the polar surfactant contained in the dispersing agent having a polarity is anionic, a cationic surfactant to be contained in the aggregating agent having a polarity can be selected. Accordingly, by selecting the polarity of the aggregating agent and adding the aggregating agent to the liquid mixture, the polarity discrepancies between the side to be added to (the liquid mixture) and the side to be added (the aggregating agent) can be compensated so that hetero aggregation is generated at this time.

It is preferable to conduct the adding and mixing process of the aggregating agent at a temperature not more than the glass transition point of the resin contained in the liquid mixture. By mixing under these temperature conditions, the aggregation can proceed in a stable manner.

The mixing process can be conducted with a known mixing device, such as a homogenizer and a mixer.

The average particle size of the aggregated particles formed hereby is not particularly limited, but in general, it is controlled to be about the same as the average particle size of the toner for electrostatic charge image development to be obtained. The control can be conducted easily by optionally setting or changing the temperature conditions and the stirring and mixing conditions.

According to the above aggregated particle forming process, aggregated particles having an average particle size substantially the same as that of the toner for electrostatic charge image development can be formed, and an aggregated particle dispersion containing the aggregated particles dispersed therein can be prepared. In the present invention, the aggregated particles are referred to as "mother particles".

(Adhered particle forming process)

The adhered particle forming process is a process where adhered particles are formed by adding and mixing a fine particle dispersion containing fine particles dispersed in a dispersing agent having a polarity to the aggregated particle dispersion, whereby the fine particles adhere to the aggregated particles. In the present invention, the adhered particle forming process is optional, and thus it can be conducted as needed.

Examples of the dispersing agent having a polarity are as mentioned above.

The fine particles are not particularly limited but can be selected optionally according to the purpose. Examples thereof include resin fine particles the same as the above-mentioned resin particles, coloring agent fine particles the same as the above-mentioned coloring agent particles, and fine particles the same as the above-mentioned releasing agent particles. Among these examples, in the present invention, the resin fine particles may be used preferably. Since the fine particles can be regarded as particles to be newly added, from the viewpoint of the aggregated particles, they can be referred to as "added particles" in the present invention.

The method for preparing the fine particle dispersion is the same as that of the resin particle dispersion, the coloring agent particle dispersion, and the particle dispersion.

The average particle size of the fine particles is, in general, 1 $\mu$m or less, and preferably from 0.01 to 1 $\mu$m. An average particle size larger than 1 $\mu$m causes the particle size distribution of a toner for electrostatic charge image development finally obtained to spread, or generates free particles, and thus easily causes a deterioration in performance and reliability. On the other hand, an average particle size within the above-mentioned range eliminates the above-mentioned problems, and is advantageous in forming the layer structure by the resin fine particles. The average particle size can be measured with coulter counter.

The volume of the above-mentioned fine particles depends upon the volume percentage of the toner for electrostatic charge image development to be obtained, and is preferably 50% or less of the volume of the toner for electrostatic charge image development to be obtained. If the volume of the fine particles exceeds 50% of the volume of the toner for electrostatic charge image development to be obtained, the fine particles do not adhere to or aggregate on the aggregated particles, so that new aggregated particles of the fine particles are formed causing significant changes in the composition distribution or particle size distribution of the toner for electrostatic charge image development to be obtained, and thus the desired properties may not be obtained.

The fine particle dispersion can be a fine particle dispersion containing one kind of the above-mentioned fine particles dispersed therein, or a fine particle dispersion containing two or more kinds of the above-mentioned fine particles dispersed therein. In the latter case, the combination of the fine particles is not particularly limited and can be optionally selected according to the purpose.

The content of the fine particles in the fine particle dispersion is, in general, 5 to 60% by weight, and preferably 10 to 40% by weight. If the content is outside the above-mentioned range, the structure and the composition of the toner for electrostatic charge image development from the inside to the surface thereof may not be sufficiently controlled. The content of the aggregated particles in the aggregated particle dispersion at the time of the aggregated particle formation is, in general, 40% by weight or less.

The method of adding and mixing the fine particle dispersion into the aggregated particle dispersion is not particularly limited, and thus the procedure can be conducted, for example, gradually and continuously or can be conducted over several separate stages. By adding and mixing the fine particles (added particles), the generation of minute particles can be restrained, and thus a sharp particle size distribution of the toner for electrostatic charge image development to be obtained can be ensured.

By conducting the adding and mixing procedure over several separate stages, layers of the above-mentioned fine particles are laminated onto the surface of the above-mentioned aggregated particles in stages, and thus structural changes or the composition gradient can be preserved from the inside to the outside of the particles of the toner for electrostatic charge image development. Therefore, the surface hardness of the particles can be improved and the particle size distribution can be maintained at the time of fusion in the fusion process later described, and the changes therein can be restricted. Moreover, the addition of a stabilizing agent such as a surfactant and a base or an acid for improving the stability at the time of fusion is either not required, or the amount thereof to be added can be kept to a minimal level, and thus it is advantageous in that cost reduction and quality improvement can be achieved.

Conditions for adhering the above-mentioned fine particles to the above-mentioned aggregated particles are as follows.

A temperature of the glass transition point of the resin of the resin particles contained in the aggregated particles or lower, and about room temperature is preferable. By heating at the temperature of the glass transition point or lower, the above-mentioned aggregated particles and the above-mentioned fine particles can be adhered easily, and consequently the aggregated particles to be formed can be easily stabilized.

Although the treatment time depends upon the above-mentioned temperature and thus cannot be determined unconditionally, it is, in general, from 5 minutes to 2 hours.

In the above-mentioned adhesion, the aggregated particle dispersion, with the above-mentioned fine particles added thereto and mixed therewith, may be allowed to stand or may be stirred gently with a mixer. The latter case is more advantageous since homogeneous adhered particles can be formed easily.

In the present invention, the number of the times the adhered particle forming process is conducted can be once or a plurality of times. In the former case, only one layer of the above-mentioned fine particles (added particles) is formed on the surface of the above-mentioned aggregated particles, whereas in the latter case, if a plurality of the fine particle dispersions are prepared, layers of the above-mentioned fine particles (added particles) contained in the fine particle dispersions are formed on the surface of the above-mentioned aggregated particles. Therefore, the latter case is advantageous in that a toner for electrostatic charge image development having a complicated and precise hierarchial structure can be obtained, so that the desired function can be provided to the toner for electrostatic charge image development.

If the adhered particle forming process is conducted for a plurality of times, any combination of fine particles to be adhered first to the above-mentioned aggregated particles and fine particles to be adhered thereto in subsequent stages can be adopted, and can be selected optionally according to the application and the like of the toner for electrostatic charge image development.

If the adhered particle forming process is conducted for a plurality of times, it is preferable to heat the dispersion containing the above-mentioned fine particles and the above-mentioned aggregated particles at the temperature of the glass transition point or less of the resin of the resin particles in the first process, whenever the above-mentioned fine particles are added and mixed, and it is more preferable to increase the heating temperature in stages. It is advantageous in that generation of free particles can be restrained by this procedure.

By the above-mentioned aggregated particle forming process, adhered particles can be formed by adhering the above-mentioned fine particles to the aggregated particles. If the adhered particle forming process is conducted for a plurality of times, adhered particles, where the above-mentioned fine particles are adhered for the plurality of times on the aggregated particles prepared in the aggregated particle forming process, can be formed. Accordingly, by adhering optionally selected fine particles to the above-mentioned aggregated particles in the adhered particle forming process, a toner for electrostatic charge image development having the desired properties can be freely designed and produced.

(Fusion process)

The above-mentioned fusion process is a process where the above-mentioned aggregated particles or the above-mentioned adhered particles are heated to be fused.

The temperature for heating may be between the glass transition point temperature of the resin contained in the aggregated particles or the adhered particles to the decomposition temperature of the resin. Therefore, the above-mentioned heating temperature varies depending upon the kind of the resin of the above-mentioned resin particles and the above-mentioned resin fine particles, and thus cannot be determined unconditionally. However, it is, in general, from the glass transition point temperature of the resin contained in the adhered particles to 180° C.

The heating procedure can be conducted with a conventionally known heating device or equipment.

A short duration of the above-mentioned fusion may be sufficient if the above-mentioned heating temperature is high, and a long duration necessary if the above-mentioned heating temperature is low. That is, since the above-mentioned heating duration depends upon the above-mentioned heating temperature, it cannot be determined unconditionally, however, it is, in general, from 30 minutes to 10 hours.

In the present invention, it is possible to wash or dry an obtained toner for electrostatic charge image development after finishing the fusion process in optional conditions. It is also possible to add inorganic particles such as silica, alumina, titania, and calcium carbonate or resin particles such as a vinyl resin, a polyester resin, and a silicone resin to the surface of the obtained toner for electrostatic charge image development while applying a shearing force in the dry state. These inorganic particles and the resin particles function as external additives such as flowability adjuvants and cleaning adjuvants.

By the above-mentioned fusion process, the aggregated particles or the adhered particles can be fused in a state where the above-mentioned aggregated particles (mother particles) as such, or in a state where the above-mentioned fine particles (added particles) are adhered onto the aggregated particles (mother particles) so that a toner for electrostatic charge image development can be produced.

<Toner for electrostatic charge image development>

A toner for electrostatic charge image development of the present invention can be produced in the above-mentioned production method of a toner for electrostatic charge image development of the present invention.

The above-mentioned toner for electrostatic charge image development has a structure with the above-mentioned aggregated particles as mother particles having the surface thereof coated with the above-mentioned fine particle layer. The above-mentioned fine particle layer may comprise one layer or two or more layers. The number thereof being the same as the number of times the adhered particle forming process in the above-mentioned production process of the toner for electrostatic charge image development of the present invention is conducted.

Since the above-mentioned toner for electrostatic charge image development has a structure where the composition and physical properties change from the inside to the surface continuously or discontinuously, and further, the coloring agent particles are present homogeneously, excellent characteristics including the charging properties, the coloring properties, the developing properties, the transfer properties, the fixing properties and the cleaning properties can be provided. The charging properties and the coloring properties are particularly good. Moreover, since the above-mentioned characteristics, particularly, the charging properties demonstrate and maintain stability regardless of the environmental conditions, it is highly reliable.

Since the above-mentioned toner for electrostatic charge image development is produced using the above-mentioned production method of the toner for electrostatic charge image development of the present invention, unlike toner produced using a kneading and pulverizing method, a small average particle size can be provided with a sharp particle size distribution.

The above-mentioned particle size of the toner for electrostatic charge image development is preferably 2 to 9 $\mu$m, and more preferably 3 to 8 $\mu$m. An average particle size smaller than 2 $\mu$m may cause insufficient charging properties reducing the developing properties, on the other hand, an average particle size larger than 9 $\mu$m may reduce the resolution properties of an image.

As an index for the above-mentioned particle size distribution of the toner for electrostatic charge image development, using D16% and D84% of the cumulative distribution, a volume GSD (volume GSD=(volume D84/volume D16)$^{0.5}$) or a numerical GSD (numerical GSD=(numerical D84/numerical D16)$^{0.5}$) can be used easily and conveniently. The above-mentioned volume GSD is preferably 1.30 or less, and more preferably 1.27 or less.

If the above-mentioned volume GSD exceeds 1.30, the developing properties may deteriorate as time passes depending on the selected development.

The charge amount of the toner for electrostatic charge image development is preferably 10 to 40 $\mu$C/g, and more preferably 15 to 35 $\mu$C. With a charge amount less than 10 $\mu$C/g, the background portion fouling maybe easily generated, on the other hand, with a charge amount exceeding 40 $\mu$C/g, the reduction of image density may be easily generated.

The ratio between the charge amount in summer and the charge amount in winter of the toner for electrostatic charge image development is preferably from 0.5 to 1.5, and more preferably from 0.7 to 1.3. A ratio outside the preferable range is not preferable in practical use since the toner depends heavily on the environment and the charging properties are not sufficiently stable.

<Electrostatic charge image developer>

The electrostatic charge image developer of the present invention can be obtained by combining the toner for electrostatic charge image development of the present invention and a carrier.

The above-mentioned carrier is not particularly limited, and conventionally-known carriers can be used. Examples thereof include the carriers disclosed in Japanese Patent Application Laid Open (JP-A) Nos. 62-39879 and 56-11461.

The mixing ratio of the toner for electrostatic charge image development of the present invention and the carrier in the above-mentioned electrostatic charge image developer is not particularly limited and can be selected optionally according to the purpose.

<Image forming method>

The image forming method of the present invention includes an electrostatic latent image forming process, a toner image forming process, and a transfer process. The above-mentioned processes are general processes, which are disclosed in Japanese Patent Application Laid Open (JP-A) Nos. 56-40868 and 49-91231. The image forming method of the present invention can be implemented in conventionally-known image forming apparatuses such as copying machines and facsimiles.

The above-mentioned electrostatic latent image forming process is a process where an electrostatic latent image is formed on an electrostatic latent image carrying member. The above-mentioned toner image forming process is a process where the above-mentioned electrostatic latent image is developed by a developer layer on a developer carrying member so as to form a toner image. The above-mentioned developer layer is not particularly limited as long as it contains the electrostatic charge image developer of the present invention. The above-mentioned transfer process is a process where the above-mentioned toner image is transferred onto a transfer body.

In the image forming method of the present invention, an embodiment further comprising a cleaning process is preferable, and an embodiment further comprising a recycling process is more preferable.

The above-mentioned cleaning process is a process where extra toner for electrostatic charge image development in the toner image formation is recovered. The above-mentioned recycling process is a process where the recovered toner for electrostatic charge image development in the above-mentioned cleaning process is transferred to the developer layer.

The image forming process of an embodiment including a cleaning process and a recycling process can be implemented in a toner recycle system type image forming apparatus, such as a copying machine and a facsimile. It can also be applied to the recycling system of an embodiment where a toner is recovered while developing without a cleaning process.

EXAMPLES

Hereinafter the embodiments of the present invention will be explained, but the present invention is not limited thereto.

| Preparation of resin particle dispersion (1) | |
|---|---|
| styrene | 370 g |
| n-butyl acrylate | 30 g |
| acrylic acid | 8 g |
| dodecane thiol | 24 g |
| carbon tetrabromide | 4 g |

The above-mentioned materials were mixed and dissolved and added to a solution prepared by dissolving 6 g of a nonionic surfactant (Nonipol 400, polyoxyethylene oxide, produced by Sanyo Chemical Industries, Ltd.) and 10 g of an anionic surfactant (Neogen S.C., sodium dodecylbenzene sulfonate produced by Daiichi Kogyo Seiyaku Co., Ltd.) to 550 g of ion exchange water, dispersed and emulsified in a flask. This was slowly mixed for 10 minutes while a solution prepared by dissolving 4 g of ammonium persulfate in 50 g of ion exchange water was added thereto. After conducting nitrogen substitution, the content of the flask was heated in an oil bath to 70° C. while being stirred. This emulsion polymerization was maintained for 5 hours.

As a result, an (anionic) resin particle dispersion (1), having an average particle size of 155 nm, a glass transition point of 59° C., and a weight average molecular weight (Mw) of 12,000 was prepared.

| Preparation of resin particle dispersion (2) | |
|---|---|
| styrene | 280 g |
| n-butyl acrylate | 120 g |
| acrylic acid | 8 g |

The above-mentioned materials were mixed and dissolved and added to a solution prepared by dissolving 6 g of a nonionic surfactant (Nonipol 400, polyethylene oxide, produced by Sanyo Chemical Industries, Ltd.) and 12 g of an anionic surfactant (Neogen S.C., sodium dodecylbenzene sulfonate produced by Daiichi Kogyo Seiyaku Co., Ltd.) to 550 g of ion exchange water, dispersed and emulsified in a flask. This was slowly mixed for 10 minutes while a solution prepared by dissolving 3 g of ammonium persulfate in 50 g of ion exchange water was added thereto. After conducting nitrogen substitution, the content of the flask was heated in an oil bath to 70° C. while being stirred. This emulsion polymerization was maintained for 5 hours. As a result, an (anionic) resin particle dispersion (2), having an average particle size of 105 nm, a glass transition point of 53° C., and a weight average molecular weight (Mw) of 550,000 was prepared.

| Preparation of releasing agent dispersion (1) | |
|---|---|
| paraffin wax (NHP0190, melting point of 85° C. produced by Nihon Seirou Co., Ltd.) | 50 g |
| anionic surfactant (Neogen SC, sodium dodecylbenzene sulfonate produced by Daiichi Kogyo Seiyaku Co., Ltd.) | 5 g |
| Ion exchange water | 200 g |

The above-mentioned materials were heated to 95° C., dispersed by a homogenizer (Ultratalax T50, produced by IKA Co., Ltd.), and then applied with a dispersion treatment by a pressure discharge type homogenizer to prepare an (anionic) releasing agent dispersion (1), having an average particle size of 550 nm.

| Preparation of coloring agent dispersion (1) | |
|---|---|
| carbon black (Morgal L, produced by Cabot Co., Ltd.) | 20 g |
| anionic surfactant (Neogen SC, sodium dodecylbenzene sulfonate produced by Daiichi Kogyo Seiyaku Co., Ltd.) | 2 g |
| ion exchange water | 78 g |

The above-mentioned materials were mixed, and dispersed for 10 minutes by an ultrasonic cleaner (W-113 produced by Honda Electronic Corp.) with an oscillating frequency of 28 kHz to prepare an (anionic) coloring agent particle dispersion (1). The particle size distribution of the (anionic) coloring agent particle dispersion (1) was measured with a particle size distribution measuring apparatus (LA-700, produced by Horiba Seisakujo Corp.) to find out that the average particle size of the coloring agent particles contained therein was 180 nm. Coarse particles exceeding 1 μm were not observed. In the coloring agent particle dispersion (1), the ratio of coloring agent particles having a maximum particle size of not more than 1 μm was 100%.

| preparation of coloring agent dispersion (2) | |
|---|---|
| carbon black (Morgal L produced by Cabot Co., Ltd.) | 20 g |
| anionic surfactant (Neogen SC, sodium dodecylbenzene sulfonate produced by Daiichi Kogyo Seiyaku Co., Ltd.) | 2 g |
| ion exchange water | 78 g |

The above-mentioned materials were mixed, and dispersed for 10 minutes with an Ultratalax T50, produced by IKA, to prepare an (anionic) coloring agent dispersion (2). The particle size distribution of the (anionic) coloring agent particle dispersion (2) was measured with a particle size distribution measuring apparatus (LA-700, produced by Horiba Seisakujo Corp.) to find out that the average particle size of the coloring agent particles contained therein was 836 nm. Coarse particles exceeding 1 μm were present. In the coloring agent particle dispersion (2), the ratio of coloring agent particles having the maximum particle size of not more than 1 μm was 60%.

| Preparation of a coloring agent dispersion (3) | |
|---|---|
| carbon black (Morgal L, produced by Cabot Co., Ltd.) | 20 g |
| cationic surfactant (Sanizol B50, dodecylbenzene dimethylammonium chloride, produced by Kao Corp.) | 4 g |
| ion exchange water | 76 g |

The above-mentioned materials were mixed, and dispersed for 10 minutes by an ultrasonic cleaner (W-113, produced by Honda Electronic Corp.) with an oscillating frequency of 28 kHz to prepare a (cationic) coloring agent particle dispersion (3). The particle size distribution of the (cationic) coloring agent particle dispersion (3) was measured with a particle size distribution measuring apparatus (LA-700, produced by Horiba Seisakujo Corp.) to find out that the average particle size of the coloring agent particles contained therein was 200 nm. Coarse particles exceeding 1 μm were not observed. In the coloring agent particle dispersion (3), the ratio of coloring agent particles having a maximum particle size of not more than 1 μm was 100%.

Example 1

| <Liquid mixture preparation process> | |
|---|---|
| (anionic) resin particle dispersion (1) | 180 g |
| (anionic) resin particle dispersion (2) | 80 g |
| (anionic) coloring agent dispersion (1) | 30 g |
| (anionic) releasing agent dispersion (1) | 50 g |

The above-mentioned materials were mixed and dispersed in a round type stainless steel flask by a homogenizer (Ultratalax T50 produced by IKA Co., Ltd.) to prepare a liquid mixture. In the liquid mixture, particles were dispersed homogeneously.

<Aggregated particles forming process>

To the liquid mixture, 1.5 g of a cationic surfactant (Sanizol B50, dodecylbenzene dimethylammonium chloride, produced by Kao Corp.) was added as an aggregating agent. The mixture was heated in a heating oil bath to 50° C. while the inside of the flask was stirred and maintained at 50° C. for 1 hour. It was confirmed that aggregated particles having an average particle size of about 5.9 μm were formed by observation with an optical microscope.

<Fusion process>

3 g of an anionic surfactant (Neogen S.C., sodium dodecyl benzene sulfonate, produced by Daiichi Kobyo Seiyaku Co., Ltd.) was added thereto, and the stainless steel flask was sealed tightly. While stirring with a magnetic seal, it was heated to 105° C. and maintained for 3 hours.

After cooling off, the reaction product was filtrated, sufficiently washed with ion exchange water, and dried to obtain a toner for electrostatic charge image development.

<Evaluation>

The average particle size of the obtained toner for electrostatic charge image development measured with coulter counter was 6.0 μm. The volume GSD, which is an index of the volume particle size distribution, was 1.22. The cross-section of the obtained toner for electrostatic charge image development was observed with a transmission type electron microscope. The dispersion degree of the coloring agent (carbon black) was good and structural aggregates were not observed. The surface state was observed with a scanning type electron microscope. Although exposure of the coloring agent (carbon black) and a wax-like substance on the surface of the toner for electrostatic charge image development was observed, no free substance was observed.

The toner for electrostatic charge image development was weighed in a glass bottle such that the toner concentration with respect to a ferrite carrier having an average particle size of 50 μm, coated in an amount of 1% with polymethyl methacrylate (produced by Soken Kagaku Corp.) was 5% by weight, and was mixed with a ball mill for 5 minutes to produce an electrostatic charge image developer. The mixing procedure was conducted in both summer environmental conditions (30° C., relative humidity 85%), and winter environmental conditions (5° C., relative humidity 10%). After the mixing procedure, the charge amount was measured with a blow off charge amount measuring device produced by Toshiba Corp. As a result, the charge amount of the toner for electrostatic charge image development was 28 μC/g in the summer environment, and 35 μC/g in the winter environment. The ratio thereof was as high as 0.8. Accordingly, the obtained toner for electrostatic charge image development showed excellent charging properties and excellent environmental stability.

Fixation of the electrostatic charge image developer was evaluated by cloth rubbing with a modified V500, produced by Fuji Xerox Co., Ltd., and a fastness tester. Sufficient fixing properties were shown at a heat roll temperature of 130° C., and offset was not generated until 220° C.

A continuous operation test was conducted with the electrostatic charge image developer. A stable image was obtained after copying 10,000 sheets without filming and the like being generated on the photosensitive member.

(Comparative Example 1)

In the same process as in Example 1 except that the (anionic) coloring agent particle dispersion (1) was replaced by the (cationic) coloring agent dispersion (3), a toner was obtained. The average particle size of the toner was 6.2 μm. The volume GSD was 1.21. The cross-section of the obtained toner was observed with a transmission type electron microscope. The dispersion structure of the coloring agent (carbon black) was uneven and a portion with the coloring agent linearly arranged and a portion without the existence of the coloring agent were observed. The surface state of the obtained toner was observed with a scanning type electron microscope. Exposure of the coloring agent and a wax-like substance was observed on the surface of the toner, and some free substance was observed.

Example 2

| <Liquid mixture preparing process> | |
|---|---|
| (anionic) resin particle dispersion (1) | 120 g |
| (anionic) resin particle dispersion (2) | 80 g |
| (anionic) coloring agent dispersion (1) | 30 g |
| (anionic) releasing agent dispersion (1) | 40 g |

The above-mentioned materials were mixed and dispersed in a round type stainless steel flask by a homogenizer (Ultratalax T50, produced by IKA Co., Ltd.) to prepare a liquid mixture. In the liquid mixture, particles were dispersed homogeneously.

<Aggregated particle forming process>

To the liquid mixture, 1.5 g of a cationic surfactant (Sanizol B50, dodecylbenzene dimethylammonium chloride, produced by Kao Corp.) was added as an aggregating agent. The mixture was heated in a heating oil bath to 48° C. while the inside of the flask was stirred and maintained at 48° C. for 30 minutes. It was confirmed that aggregated particles having an average particle size of about 5 μm were formed by observation with an optical microscope.

<Adhered particle forming process>

60 g of the resin particle dispersion (1) was slowly added thereto. The temperature of the heating oil bath was raised to 50° C. and maintained for 1 hour. The volume of the resin particles contained in the resin particle dispersion to be added into the above-mentioned aggregated particle dispersion corresponded to 23% of the volume of the obtained toner particles. It was confirmed that adhered particles having an average particle size of about 5.7 μm were formed by observation with an optical microscope.

<Fusion process>

3 g of an anionic surfactant (Neogen S.C., sodium dodecyl benzene sulfonate, produced by Daiichi Kogyo Seiyaku Co., Ltd.) was added thereto, and the stainless steel flask was sealed tightly. While being stirred with a magnetic seal, it was heated to 105° C. and maintained for 3 hours.

After cooling off, the reaction product was filtrated, sufficiently washed with ion exchange water, and dried to obtain a toner for electrostatic charge image development.

<Evaluation>

The average particle size of the obtained toner for electrostatic charge image development measured with coulter counter was 5.8 μm. The volume GSD, which is an index of the volume particle size distribution, was 1.24. The cross-section of the obtained toner for electrostatic charge image development was observed with a transmission type electron microscope. The dispersion degree of the coloring agent (carbon black) was good and structural aggregates were not observed. The surface state was observed with a scanning type electron microscope. Exposure of the coloring agent (carbon black) or a wax-like substance was not observed on the surface of the toner for electrostatic charge image development.

The toner for electrostatic charge image development was weighed in a glass bottle such that the toner concentration with respect to the ferrite carrier having an average particle size of 50 μm, coated in an amount of 1% with polymethyl methacrylate (produced by Soken Kagaku Corp.) was 5% by weight, and was mixed with a ball mill for 5 minutes to produce an electrostatic charge image developer. The mixing procedure was conducted in both summer environmental conditions (30° C., relative humidity 85%), and winter environmental conditions (5° C., relative humidity 10%). After the mixing procedure, the charge amount was measured with a blow off charge amount measuring device produced by Toshiba Corp. As a result, the charge amount of the toner for electrostatic charge image development was 28 μC/g in the summer environment, and 35 μC/g in the winter environment. The ratio thereof was as high as 0.8. Accordingly, the obtained toner for electrostatic charge image development showed excellent charging properties and excellent environmental stability.

Fixation of the electrostatic charge image developer was evaluated by cloth rubbing with a modified V500, produced by Fuji Xerox Co., Ltd., and a fastness tester. Sufficient fixing properties were shown at a heat roll temperature of 130° C., and offset was not generated until 220° C.

A continuous operation test was conducted with the electrostatic charge image developer. A stable image was obtained after copying 10,000 sheets without filming or the like being generated on a photosensitive member.

(Comparative Example 2)

In the same process as in Example 2 except that the (anionic) coloring agent particle dispersion (1) was replaced by the (cationic) coloring agent dispersion (3), a toner was obtained. The average particle size of the toner was 6.3 μm. The volume GSD was 1.22. The cross-section of the obtained toner was observed with a transmission type electron microscope. The dispersion structure of the coloring agent (carbon black) was uneven and a portion with the coloring agent linearly arranged and a portion without the existence of the coloring agent were observed. The surface state of the obtained toner was observed with a scanning type electron microscope. Exposure of the coloring agent and a wax-like substance was slightly observed on the surface of the toner, and a small amount of free substance was observed.

Example 3

In the same process as in Example 2 except that the (anionic) coloring agent particle dispersion (1) was replaced by the (anionic) coloring agent dispersion (2), a toner was obtained. The average particle size of the toner was 5.8 μm. The volume GSD was 1.22. However, a great number of small sized particles were present and the numerical GSD was 1.35, which is poor.

Furthermore, the cross-section of the obtained toner was observed with a transmission type electron microscope. It was observed that the coloring agent (carbon black) was hardly present and was not sufficiently taken into the toner. The coloring degree of the obtained toner was low and the toner looked gray. The surface state of the obtained toner was observed with a scanning type electron microscope. Exposure of the coloring agent (carbon black) and a wax-like substance was slightly observed on the surface of the toner, and a small amount of free substance was observed. However, the toner could be put into actual use without causing any problems.

Example 4

In the same process as in Example 1 except that the coloring agent particles (carbon black) in the (anionic) coloring agent particle dispersion (1) were replaced by copper phthalocyanine (PV FAST BLUE, produced by BASF Corp.), a toner was obtained. The average particle size of the copper phthalocyanine was 150 nm. Coarse particles exceeding 1 μm were not observed. The volume GSD of the obtained toner was 1.20. The cross-section of the obtained toner was observed with a transmission type electron microscope. The dispersion degree of the coloring agent (copper phthalocyanine) was good and structural aggregates were not observed. The surface state was observed with a scanning type electron microscope. Exposure of a wax-like substance on the surface of the toner was slight, and no free substance was observed.

Example 5

In the same process as in Example 1 except that the coloring agent particles (carbon black) in the (anionic) coloring agent particle dispersion (1) were replaced by a quinacrydone pigment (ECR183, produced by Dainichiseika Corp.), a toner was obtained. The average particle size of the quinacrydone pigment was 241 nm. Coarse particles exceeding 1 μm were not observed. The volume GSD of the obtained toner was 1.24. The cross-section of the obtained toner was observed with a transmission type electron microscope. The dispersion degree of the coloring agent (quinacrydone pigment) was good and structural aggregates were not observed. The surface state was observed with a scanning type electron microscope. Exposure of a wax-like substance on the surface of the toner was slight, and no free substance was observed.

Example 6

In the same process as in Example 1 except that the coloring agent particles (carbon black) in the (anionic) coloring agent particle dispersion (1) were replaced by a monoazo pigment (IO-NO28, produced by Dainichiseika Corp.), a toner was obtained. The average particle size of the gininacrydone pigment was 316 nm. Coarse particles exceeding 1 μm were not observed. The volume GSD of the obtained toner was 1.23. The cross-section of the obtained toner was observed with a transmission type electron microscope. The dispersion degree of the coloring agent (menoazo pigment) was good and structural aggregates were not observed. The surface state was observed with a scanning type electron microscope. Exposure of a wax-like substance on the surface of the toner was slight, and no free substance was observed.

What is claimed is:

1. A method of preparing a toner for electrostatic charge image development comprising:

a liquid mixture preparation process for preparing a liquid mixture by mixing at least a resin particle dispersion prepared by dispersing resin particles in a solution including a first dispersing agent having a polarity, and a coloring agent particle dispersion prepared by dispersing coloring agent particles in a solution including a second dispersing agent having a polarity, an aggregated particle dispersion preparation process for preparing an aggregated particle dispersion by forming aggregated particles in the liquid mixture, and a fusion process for fusing the aggregated particles by heating, wherein the first dispersing agent and the second dispersing agent have the same polarity.

2. The method of preparing a toner for electrostatic charge image development according to claim 1, wherein the aggregated particle forming process is a process for preparing an aggregated particle dispersion by forming aggregated particles in the liquid mixture by adding to the liquid mixture an aggregating agent having the opposite polarity to that of the dispersing agent contained in the liquid mixture.

3. The method of preparing a toner for electrostatic charge image development according to claim 1, further comprising a particle forming process for forming particles by adding and mixing a fine particle dispersion containing fine particles dispersed in a dispersing agent having a polarity to the aggregated particle dispersion after the aggregated particle forming process so that the fine particles are adhered to the aggregated particles.

4. The method of preparing a toner for electrostatic charge image development according to claim 3, wherein the volume of the fine particles is 50% or less of the volume of the toner particles to be obtained.

5. The method of preparing a toner for electrostatic charge image development according to claim 3, wherein the average particle size of the fine particles is 1 μm or less.

6. The method of preparing a toner for electrostatic charge image development according to claim 1, wherein the average particle side of the resin particles is 1 μm or less.

7. The method of preparing a toner for electrostatic charge image development according to claim 1, wherein the aggregated particles contain releasing agent particles.

8. The method of preparing a toner for electrostatic charge image development according to claim 1, wherein the average particle size of the coloring agent particles is 0.5 μm or less.

9. The method of preparing a toner for electrostatic charge image development according to claim 1, wherein the coloring agent particles contain particles with a maximum particle size of 1 μm or less by 95% or more.

10. The method of preparing a toner for electrostatic charge image development according to claim 1, wherein the coloring agent particles are a carbon black pigment, and the coloring agent dispersion is prepared by dispersing the carbon black particles in a dispersing agent having a polarity using an ultrasonic wave with an oscillating frequency of 60 kHz or less.

11. The method of preparing a toner for electrostatic charge image development according to claim 1, wherein the dispersing agent contained in the coloring agent particle dispersion is alkylbenzene sulfonate or alkylsulfate ester.

12. A toner for electrostatic charge image development obtained by a method of preparing a toner for electrostatic charge image development comprising a liquid mixture preparation process for preparing a liquid mixture by mixing at least a resin particle dispersion prepared by dispersing resin particles in a solution including a first dispersing agent having a polarity, and a coloring agent particle dispersion prepared by dispersing coloring agent particles in a solution including a second dispersing agent having a polarity, an aggregated particle dispersion preparing process for preparing an aggregated particle dispersion by forming aggregated particles in the liquid mixture, and a fusion process for fusing the aggregated particles by heating, wherein the first dispersing agent and the second dispersing agent have the same polarity.

13. The toner for electrostatic charge image development according to claim 12, wherein the aggregated particle forming process is a process for preparing an aggregated particle dispersion by forming aggregated particles in the liquid mixture by adding to the liquid mixture an aggregating agent having the opposite polarity to that of the dispersing agent contained in the liquid mixture.

14. The toner for electrostatic charge image development according to claim 12, further comprising a particle forming process for forming particles by adding and mixing a fine particle dispersion containing fine particles dispersed in a dispersing agent having a polarity to the aggregated particle dispersion after the aggregated particle forming process so that the fine particles are adhered to the aggregated particles.

15. An electrostatic charge image developer containing a carrier for electrophotography and a toner for electrostatic charge image development obtained by a method of preparing a toner for electrostatic charge image development comprising a liquid mixture preparing process for preparing a liquid mixture by mixing at least a resin particle dispersion prepared by dispersing resin particles in a solution including a first dispersing agent having a polarity, and a coloring agent particle dispersion prepared by dispersing coloring agent particles in a solution including a second dispersing agent having a polarity, an aggregated particle dispersion preparing process for preparing an aggregated particle dispersion by forming aggregated particles in the liquid mixture, and a fusion process for fusing the aggregated particles by heating, wherein the first dispersing agent and the second dispersing agent have the same polarity.

16. The electrostatic charge image developer according to claim 15, wherein the aggregated particle forming process is a process for preparing a aggregated particle dispersion by forming aggregated particles in the liquid mixture by adding to the liquid mixture an aggregating agent having the opposite polarity to that of the dispersing agent contained in the liquid mixture.

17. The electrostatic charge image developer according to claim 15, further comprising a particle forming process for forming particles by adding and mixing a fine particle dispersion containing fine particles dispersed in a dispersing agent having a polarity to the aggregated particle dispersion after the aggregated particle forming process so that the fine particles are adhered to the aggregated particles.

18. An image forming method comprising a process for forming an electrostatic latent image on an electrostatic latent image carrying member, a process for forming a toner image by developing the electrostatic latent image using a developer layer on a developing carrying member, and a transfer process for transferring the toner image onto a transferring member, wherein the developer layer contains a toner for electrostatic charge image development obtained by a method of preparing a toner for electrostatic charge image development comprising the steps of a liquid mixture preparation process for preparing a liquid mixture by mixing at least a resin particle dispersion prepared by dispersing resin particles in a solution including a first dispersing agent having a polarity, and a coloring agent particle dispersion prepared by dispersing coloring agent particles in a solution including a second dispersing agent having a polarity, an aggregated particle dispersion preparation process for preparing an aggregated particle dispersion by forming aggregated particles in the liquid mixture, and a fusion process for fusing the aggregated particles by heating, wherein the first dispersing agent and the second dispersing agent have the same polarity.

19. The image forming method according to claim 18, wherein the aggregated particle forming process is a process for preparing an aggregated particle dispersion by forming aggregated particles in the liquid mixture by adding to the liquid mixture an aggregating agent having the opposite polarity to that of the dispersing agent contained in the liquid mixture.

20. The image forming method according to claim 18, further comprising a particle forming process for forming particles by adding and mixing a fine particle dispersion containing fine particles dispersed in a dispersing agent having a polarity to the aggregated particle dispersion after the aggregated particle forming process so that the fine particles are adhered to the aggregated particles.

* * * * *